United States Patent [19]

Araki et al.

[11] Patent Number: 4,843,058

[45] Date of Patent: Jun. 27, 1989

[54] THERMOSENSITIVE RECORDING SHEET

[75] Inventors: Shingo Araki, Settsu; Kikuo Tsuchiya, Nishinomiya; Masaji Inagaki, Ashiva; Yumi Kudoh, Osaka; Teijiro Kitao, Tondabayashi, all of Japan

[73] Assignee: Dainippon Ink and Chemicals, Inc., Tokyo, Japan

[21] Appl. No.: 177,159

[22] Filed: Apr. 4, 1988

[30] Foreign Application Priority Data

Apr. 7, 1987 [JP] Japan ..... 62-85507

[51] Int. Cl.[4] ..... B41M 5/18

[52] U.S. Cl. ..... 503/209; 427/150; 427/151; 428/913; 503/208; 503/225

[58] Field of Search ..... 427/150–152; 428/913; 503/208, 209, 225

[56] References Cited

FOREIGN PATENT DOCUMENTS

| | | | |
|---|---|---|---|
| 139740 | 4/1979 | Japan | 503/208 |
| 74762 | 5/1979 | Japan | 503/208 |
| 0149395 | 7/1986 | Japan | 503/209 |
| 2089654 | 4/1987 | Japan | 503/209 |
| 0245836 | 11/1987 | Japan | 503/209 |

*Primary Examiner*—Bruce H. Hess

*Attorney, Agent, or Firm*—Sherman and Shalloway

[57] ABSTRACT

A thermosensitive recording sheet having a coated film containing a color-forming lactone compound, an acidic substance and a sensitizer, said sensitizer being a sulfur-containing dibasic acid ester represented by formula (I)

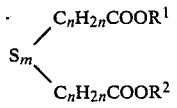

(I)

wherein n is an integer of 1 to 3, m is an integer of 1 or 2, $R^1$ and $R^2$ may be the same or different and each denotes an alkyl group having 1 to 20 carbon atoms, a cycloalkyl group, an aryl group, $—C_lH_{2l}—Ar$ or $—C_lH_{2l}—CO—Ar$ in which 1 is an integer of 1 to 8 and Ar denotes an aryl group, provided the alkyl group having 1 to 20 carbon atoms may be substituted by a halogen atom, and the cycloalkyl group, the aryl group and Ar of $—C_lH_{2l}—Ar$ or $—C_lH_{2l}—CO—Ar$ may be substituted by an alkyl group, a cycloalkyl group, an aryl group, an aralkyl group, a phenacyl group, an alkyloxy group, an aryloxy group, an aralkyloxy group, an arylcarbonyl group, an arylsulfonyl group, a nitro group, an ammonium sulfonic acid group or a halogen atom.

6 Claims, No Drawings

THERMOSENSITIVE RECORDING SHEET

This invention relates to a thermosensitive recording sheet, and more specifically, to a thermosensitive recording sheet having a coated film containing a color-forming lactone compound, an acidic substance and a specific sulfur-containing dibasic acid ester as a sensitizer.

Thermosensitive recording sheets are designed to display images such as characters and geometric figures by thermal energy, and have recently found applications in various printer recorders, facsimiles, POS labels and automatic ticket examination. There are various methods of thermosensitive recording. From the viewpoint of the clearness, resolution and color of images, the most prevalent method is to use a color-forming lactone compound such as Crystal Violet Lactone (CVL) which is a dye precursor and an acidic substance capable of causing the lactone compound to form a color. In this method, a phenolic compound such as bisphenol A which is solid at room temperature but upon heating, is melted and acts as an acid component has previously been used as the acidic substance. Thermosensitive recording sheets used in this case are required to have a high degree of whiteness and excellent stability in the colored portion and the noncolored portion. Usually, to obtain a brilliant color, the sheets must be maintained at a temperature of about 140° to 150° C. for a period of time above a certain limit. Hence, various approaches have been made in order to obtain brilliant colors more rapidly and more easily. For example, there are a method in which stearamide is added as a sensitizer (Japanese Laid-Open Patent Publication No. 139740/1979), and a method in which benzyl p-hydroxybenzoate is used as the acidic substance (Japanese Laid-Open Patent Publication No. 74762/1979). The methods described in these patent documents are still not entirely satisfactory although they can increase color-forming sensitivity. Nor are they satisfactory regarding stability at the colored and non-colored portions.

An object of this invention is to remedy the foregoing drawbacks in the prior art.

The present inventors have made studies to achieve the object and as a result, discovered that the use of a specific sulfur-containing dibasic acid ester as a sensitizer can give a thermosensitive recording sheet having a much higher effect of increasing color-forming sensitivity than in the case of using conventional sensitizers, and has excellent stability in the colored and non-colored portions.

According to this invention, there is provided a thermosensitive recording sheet having a coated film containing a color-forming lactone compound, an acidic substance and a sensitizer, said sensitizer being a sulfur-containing dibasic acid ester represented by formula (I)

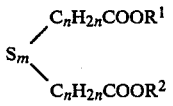

(I)

wherein n is an integer of 1 to 3, m is an integer of 1 or 2, $R^1$ and $R^2$ may be the same or different and each denotes an alkyl group having 1 to 20 carbon atoms, a cycloalkyl group, an aryl group, $—C_lH_{2l}—Ar$ or $—C_lH_{2l}—CO—Ar$ in which l is an integer of 1 to 8 and Ar denotes an aryl group, provided the alkyl group having 1 to 20 carbon atoms may be substituted by a halogen atom, and the cycloalkyl group, the aryl group and Ar of $—C_lH_{2l}—Ar$ or $—C_lH_{2l}—CO—Ar$ may be substituted by an alkyl group, a cycloalkyl group, an aryl group, an aralkyl group, a phenacyl group, and alkyloxy group, an aryloxy group, an aralkyloxy group, an arylcarbonyl group, an arylsulfonyl group, a nitro group, an ammonium sulfonic acid group or a halogen atom.

The thermosensitive recording sheet of this invention is quite high in color-forming sensitivity and excellent in stability at the colored and non-colored portions. The reason why it has quite excellent colorforming sensitivity is not clear. This is presumably because the sulfur-containing dibasic acid ester of formula (I) used in this invention as the sensitizer does not act at room temperature, but when melted upon heating, it is rapidly hydrolyzed by the acidic substance also melted, e.g. bisphenol A, to form a strongly acidic sulfur-containing dibasic acid whereby the ring opening of the color-forming lactone compound is promoted to markedly accelerate color formation.

Regarding the sulfur-containing dibasic acid ester of formula (I), esters represented by the following formulas (1) to (3) are preferable. The ester of formula (1) is most preferable.

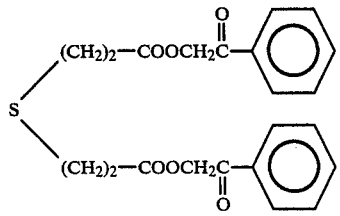

(1)

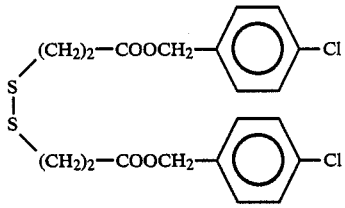

(2)

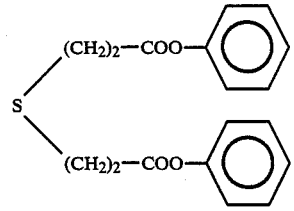

(3)

Examples of the color-forming lactone compound used in this invention include fluoranphthalides such as 3,3-bis(p-dimethylaminophenyl)phthalide, 3,3-bis(p-dimethylaminophenyl)-6-dimethylaminophthalide (also known as Crystal Violet Lactone; CVL for short), 3,3-bis(p-dimethylaminophenyl)-6-aminophthalide, 3,3-bis(p-dimethylaminophenyl)-6-nitrophthalide, 3,3-bis(p-dimethylaminophenyl)phthalide, 3,3-bis-3-dimethylamino-7-methylfluoran, 3-diethylamino-7-chlorofluoran, 3-diethylamino-6-chloro-7-methylfluoran, 3-diethylamino-7-anilinofluoran, 3-diethylamino-6-methyl-7-anilinofluoran, 3-piperidino-6-methyl-7-anilinofluoran, 3-(N-ethyl-p-toluidino)-7-(N-methylanilino)-fluoran, 3-(N-ethyl-p-tolidino)-6-methyl-7-anilinofluoran, 3-N-ethyl-N-isoamylamino-6-methyl-7-anilinofluoran, 3-N-methyl-N-cyclohexylamino-6-methyl-7-anilinofluoran and 3-N,N-diethylamino-7-o-chloroanilinofluoran; lactams such as Rhodamin B lactam; and spiropyrans such as 3-methylspirodinaphtopyran, 3-ethylspirodinaphthopyran and 3-benzylspironaphthopyran. These compounds should be colorless or pale-colored and react with acidic substances to form colors.

The acidic substance used in this invention may be any acidic substrance which is solid at room temperature and when heated to about 60° to 180° C., is melted and opens the lactone ring of the color-forming-lactone compound. It functions well in the presence of sensitizers. Examples of the acidic substance include 4-phenylphenol, 4-hydroxyacetophenone, 2,2'-dihydroxydiphenyl, 2,2'-methylenebis(4-chlorophenol), 2,2'-methylenebis(4-methyl-6-t-butylphenol), 4,4'-isopropylidenediphenol (also known as bisphenol A), 4,4'-isopropylidenebis(2-chlorophenol), 4,4'-isopropylidenebis(2-methylphenol), 4,4'-ethylenebis(2-methylphenol), 4,4'-thiobis(6-t-butyl-3-methylphenol), 1,1-bis(4-hydroxyphenyl)-cyclohexane, 2,2'-bis(4-hydroxyphenyl)-n-heptane, 4,4'-cyclohexylidenebis(2-isopropylphenol), 4,4'-sulfonyldiphenol, salicylanilide, novolak-type phenolic resin and benzyl p-hydroxybenzoate.

The acidic substance is used in an amount of usually 10 to 1,000 parts by weight (all parts hereinafter are by weight), preferably 100 to 500 parts, per 100 parts of the color-forming lactone compound.

The sensitizer is used in an amount of usually 1 to 1,000 parts, preferably 30 to 100 parts, per 100 parts of the acidic substance.

The color-forming lactone compound, the acidic substance and the sensitizer are used in the form of fine particles, preferably fine particles having a particle diameter of less than several microns.

Various known methods can be used to produce the thermosensitive recording sheet. Usually, there may be used (1) a method which comprises preparing a coating dispersion of the color-forming lactone compound, the acidic substance and the sensitizer in water, and coating the coating dispersion on a sheet substrate, and (2) a method which comprises dispersing the color-forming lactone compound and the acidic substance separately in water, including the sensitizer into at least one of the aqueous coating dispersions, and coating the coating dispersions in superimposed relation on a sheet substrate. An aqueous binder should be added to the coating dispersions. Examples of the binder are polyvinyl alcohol, methyl cellulose, hydroxyethyl cellulose, carboxymethyl cellulose, starches, and styrene/maleic acid copolymer. Besides, ultraviolet absorbers (for example, benzophenone compounds and triazole compounds) fillers such as calcium carbonate, lubricants such as polyethylene wax and paraffin wax, agents for imparting water resistance, and other various chemicals may be added to the coating dispersions in order to improve their performance. Various dispersing agents for dispersing the various chemicals in the above coating dispersions may also be added.

The coating dispersion is coated on a sheet substrate so that its dry weight becomes generally 2 to 12 g per $m^2$ of the sheet substrate, and then dried at room temperature to about 50° C. to give the thermosensitive recording sheet of the invention.

Paper is generally used as the sheet substrate, but plastic sheets and nonwoven sheets may also be used.

The thermosensitive recording sheet of this invention has very high color-forming sensitivity and its colored and non-colored portions have excellent stability.

The following Examples, Comparative Examples and Test Example illustrate the present invention more specifically. It should be understood that the invention is not limited at all by these examples. All parts and percentages in these examples are by weight.

EXAMPLE 1

| | |
|---|---|
| Dispersion A (containing a dye) | |
| 3(N—ethyl-p-toluidino)-6-methyl-7-anilinofluoran | 1.0 part |
| Sulfur-containing dibasic acid ester of formula (1) | 2.0 parts |
| 10% Aqueous solution of polyvinyl alcohol | 3.0 parts |
| Water | 5.0 parts |
| Total | 11.0 parts |
| Dispersion B (containing an acidic substance) | |
| bisphenol A | 3.0 parts |
| Calcium carbonate | 3.0 parts |
| Zinc stearate | 0.5 part |
| 10% Aqueous solution of polyvinyl alcohol | 7.0 parts |
| Water | 10.0 parts |
| Total | 23.5 parts |

Dispersions A and B were separately prepared by mixing the indicated ingredients and pulverizing and dispersing them by a paint conditioner.

Subsequently, 11.0 parts of dispersion A and 23.5 parts of dispersion B were mixed to form a thermo-sensitive coating dispersion. It was coated on high-quality paper at a rate of 64.5 g/$m^2$ so that its amount upon drying became 3 g/$m^2$, and then dried to obtain a thermosensitive recording sheet in accordance with this invention.

The sheet had excellent color-forming sensitivity and excellent stability at the colored and non-colored portions.

EXAMPLES 2 AND 3

Thermosensitive recording sheets in accordance with this invention were prepared in the same way as in Example 1 except that the sulfur-containing dibasic acid esters of formulas (2) and (3) were used instead of the sulfur-containing dibasic acid ester of formula (1).

The sheets had excellent color-forming sensitivity and excellent stability at the colored and noncolored portions.

EXAMPLE 4

A thermosensitive recording sheet in accordance with this invention was prepared in the same way as in Example 1 except that the amount of the sulfur-containing dibasic acid ester of formula (1) added was changed to 1.0 part and the amount of dispersion A was changed to 10 parts.

The sheet had excellent color-forming sensitivity and excellent stability at the colored and non-colored portions.

EXAMPLE 5

A thermosensitive recording sheet in accordance with this invention was prepared in the same way as in Example 1 except that the amount of the sulfur-containing dibasic acid ester was changed to 4.0 parts and the amount of dispersion A used was changed to 13 parts.

The sheet had excellent color-forming sensitivity and excellent stability at the colored and non-colored portions.

COMPARATIVE EXAMPLE 1

A thermosensitive recording sheet for comparison was prepared in the same way as in Example 1 except that the sulfur-containing dibasic acid ester of formula (1) was not added and the amount of dispersion A used was changed to 9.0 parts.

The sheet had inferior color-forming sensitivity.

COMPARATIVE EXAMPLE 2

A thermosensitive recording sheet for comparison was prepared in the same way as in Example 1 except that stearamide was used instead of the sulfur-containing dibasic acid ester of formula (1).

The sheet was inferior in color-forming sensitivity and stability at the colored and non-colored portions.

COMPARATIVE EXAMPLE 3

A thermosensitive recording sheet for comparison was prepared in the same way as in Example 1 except that the sulfur-containing dibasic acid ester of formula (1) was not added, the amount of dispersion A was changed to 9 parts and benzyl p-hydroxybenzoate was used instead of bisphenol A.

The sheet was inferior in color-forming sensitivity and stability at the colored portion.

TEST EXAMPLE 1

The thermosensitive recording sheets obtained in Examples 1 to 5 and Comparative Examples 1 to 3 were tested for dynamic image density, and the stability of the colored and non-colored portions by methods described below. The results are shown in Table 1.

Measurement of the dynamic image density

An image was printed on the thermosensitive recording sheet by means of a thermal head printing device (Model MSI, made by Matsushita Electronic Components Co., Ltd.) with a pulse width of 0.5 millisecond, and the density of the image was measured by a Macbeth densitometer (RD-918, made by Macbeth Co., U. S. A.).

Evaluation (A) of the stability of the colored and non-colored portions

The sheet was pressed against a hot plate at 140° C. under a pressure of 2.0 kg/cm$^2$ for 1 second. The colored portion and the remaining non-colored portion were left to stand at 40° C. and 90% RH for 24 hours. The degree of whitening or background fog of the colored and noncolored portions was visually observed and evaluated on the following scale.

(1) Scale of evaluation of the colored portion

⊙ : No whitening

○: Hardly any whitening

Δ: Whitening occurred

X: Marked whitening (2) Scale of evaluation of the non-colored portion

⊙ : No background fog

○: Hardly any background fog

Δ: Background fog occurred

X: Marked background fog

Evaluation (B) of the stability of the colored and non-colored portions

Evaluated by the same procedure as in evaluation (A) except that the colored and non-colored portions were left to stand for three months at 50° C. and 55% RH.

TABLE 1

| | Dynamic image density | Stability evaluation (A) | | Stability evaluation (B) | |
|---|---|---|---|---|---|
| | | Colored portion | Non-colored portion | Colored portion | Non-colored portion |
| Example 1 | 1.15 | ⊙ | ⊙ | ⊙ | ⊙ |
| Example 2 | 1.09 | ⊙ | ⊙ | ⊙ | ○ |
| Example 3 | 1.08 | ⊙ | ⊙ | ⊙ | ⊙ |
| Example 4 | 1.08 | ⊙ | ⊙ | ⊙ | ⊙ |
| Example 5 | 1.16 | ⊙ | ○ | ⊙ | ○ |
| Comparative Example 1 | 0.53 | ○ | ⊙ | ○ | ⊙ |
| Comparative Example 2 | 0.73 | X | Δ | X | Δ |
| Comparative Example 3 | 0.63 | X | ○ | X | ○ |

What we claim is:

1. A thermosensitive recording sheet comprising a substrate sheet and a film coated on said substrate sheet, said film comprising a color-forming lactone compound, an acidic substance and a sensitizer, said sensitizer being a sulfur-containing dibasic acid ester represented by formula (I)

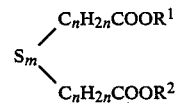

(I)

wherein n is an integer of 1 to 3, m is an integer of 1 or 2, $R^1$ and $R^2$ may be the same or different and each denotes an alkyl group having 1 to 20 carbon atoms, a cycloalkyl group, an aryl group, $—C_lH_{2l}—Ar$ or $—C_lH_{2l}—CO-Ar$ in which l is an integer of 1 to 8 and Ar denotes an aryl group, provided the alkyl group having 1 to 20 carbon atoms may be substituted by a halogen atom, and the cycloalkyl group, the aryl group and Ar of $—C_lH_{2l}—Ar$ or $—C_lH_{2l}—CO—Ar$ may be substituted by an alkyl group, a cycloalkyl group, an aryl group, an aralkyl group, a phenacyl group, an alkyloxy group, an aryloxy group, an aralkyloxy group, an arylcarbonyl group, an arylsulfonyl group, a nitro group, an ammonium sulfonic acid group or a halogen atom.

2. The thermosensitive recording sheet of claim 1 wherein the sensitizer is at least one of sulfur-containing dibasic acid esters represented by formulas (1) to (3)

(1)

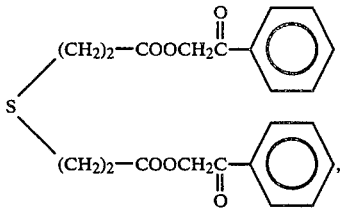

(2)

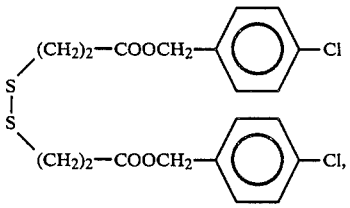

and

-continued (3)

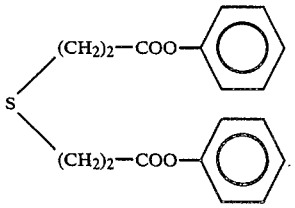

3. The thermosensitive recording sheet of claim 1 wherein the sensitizer is a sulfur-containing dibasic ester acid represented by formula (1)

(1)

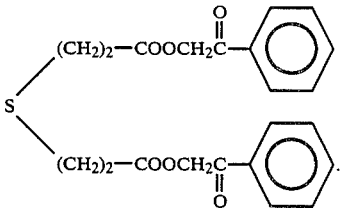

4. The thermosensitive recording sheet of claim 1, 2 or 3 wherein the amount of the acidic substance in the coated film is 100 to 500 parts by weight per 100 parts by weight of the color-forming lactone compound.

5. The thermosensitive recording sheet of claim 4 wherein the amount of the sensitizer in the coated film is 30 to 100 parts by weight per 100 parts by weight of the acidic substance.

6. The thermosensitive recording sheet of claim 1, 2 or 3 wherein the amount of the sensitizer in the coated film is 30 to 100 parts by weight per 100 parts by weight of the acidic substance.

* * * * *